United States Patent [19]

Clabburn

[11] Patent Number: 4,781,606

[45] Date of Patent: Nov. 1, 1988

[54] WIRE STRIPPING ARRANGEMENT

[75] Inventor: Robin J. T. Clabburn, Menlo Park, Calif.

[73] Assignee: Raychem Corporation, Menlo Park, Calif.

[21] Appl. No.: 169,080

[22] Filed: Mar. 16, 1988

Related U.S. Application Data

[63] Continuation of Ser. No. 329,977, Dec. 11, 1981, abandoned.

[30] Foreign Application Priority Data

Dec. 12, 1980 [GB] United Kingdom ..... 8039951

[51] Int. Cl.[4] ..... H01R 4/24

[52] U.S. Cl. ..... 439/161; 439/393; 439/421

[58] Field of Search ..... 439/161, 391–421

[56] References Cited

U.S. PATENT DOCUMENTS

| | | | |
|---|---|---|---|
| 2,027,962 | 1/1936 | Currie . | |
| 3,086,242 | 4/1963 | Cook et al. . | |
| 3,168,615 | 2/1965 | Owen et al. . | |
| 3,174,851 | 3/1965 | Buehler et al. . | |
| 3,239,125 | 3/1966 | Sherlock | 339/DIG. 1 |
| 3,283,061 | 11/1966 | Bolling | 339/DIG. 1 |
| 3,288,914 | 11/1966 | Fuller et al. | 339/97 R |
| 3,297,819 | 1/1967 | Wetmore . | |
| 3,326,442 | 6/1967 | Fattor . | |
| 3,351,463 | 11/1967 | Rozner et al. . | |
| 3,525,799 | 8/1970 | Ellis | 339/DIG. 1 |
| 3,622,941 | 11/1971 | Wetmore | 339/98 |
| 3,633,153 | 1/1972 | Biebach . | |
| 3,636,238 | 1/1972 | Biebach . | |
| 3,740,839 | 6/1973 | Otte et al. | 29/628 |
| 3,753,700 | 8/1973 | Harrison et al. . | |
| 3,759,552 | 9/1973 | Levinsohn et al. . | |
| 3,783,037 | 1/1974 | Brook et al. . | |
| 3,790,918 | 2/1974 | Dauser . | |
| 3,825,881 | 7/1974 | Wigby | 339/97 |
| 3,851,945 | 12/1974 | Collier | 339/97 |
| 3,895,852 | 7/1975 | Wasserlein . | |
| 3,937,403 | 2/1976 | Lawson | 339/97 |
| 3,989,339 | 11/1976 | Haitmanek | 339/97 |
| 4,019,925 | 4/1977 | Nenno et al. . | |
| 4,036,669 | 9/1977 | Brook et al. . | |
| 4,067,752 | 1/1978 | Brook et al. . | |
| 4,095,999 | 6/1978 | Brook et al. . | |
| 4,144,104 | 3/1979 | Brooks . | |
| 4,146,392 | 3/1979 | Brooks . | |
| 4,149,911 | 4/1979 | Clabburn . | |
| 4,166,739 | 9/1979 | Brooks . | |
| 4,221,457 | 9/1980 | Allen et al. . | |
| 4,233,731 | 11/1980 | Clabburn et al. . | |
| 4,237,609 | 12/1980 | Clabburn et al. . | |

FOREIGN PATENT DOCUMENTS

| | | |
|---|---|---|
| 1134240 | 11/1968 | United Kingdom . |
| 1203276 | 8/1970 | United Kingdom . |
| 1270367 | 4/1972 | United Kingdom . |
| 1304596 | 1/1973 | United Kingdom . |
| 1327441 | 8/1973 | United Kingdom . |
| 1327442 | 8/1973 | United Kingdom . |
| 1440524 | 6/1976 | United Kingdom . |
| 1579734 | 11/1980 | United Kingdom . |

*Primary Examiner*—Joseph H. McGlynn

*Attorney, Agent, or Firm*—Simon J. Belcher; Herbert G. Burkard

[57] ABSTRACT

The invention is a wire-stripping arrangement having recoverable material preferably in the form of heat-recoverable metal which is arranged to be capable upon recovery of cutting into the wire insulation and then to strip the insulation.

15 Claims, 2 Drawing Sheets

WIRE STRIPPING ARRANGEMENT

This application is a continuation of application Ser. No. 329,977 filed Dec. 11, 1981, abandoned.

BACKGROUND OF THE INVENTION

This invention relates to a wire-stripping arrangement for stripping the insulation of an elongate insulated electrical conductor, and finds particular, though not exclusive, application in an electrical connector. More particularly, the invention relates to a wire-stripping arrangement employing "recoverable" or "independently recoverable" means for stripping insulation.

A "recoverable" article is one whose dimensional configuration may be made to change when subjected to an appropriate treatment. Usually these articles recover towards an original shape from which they have previously been deformed but the term "recoverable", as used herein, also includes an article which adopts a new configuration, even if it has not been previously deformed. The article may be heat recoverable, such that its dimensional configuration may be made to change when subjected to heat treatment. Examples of recoverable articles are given in U.S. Pat. Nos. 4,149,911, 4,221,457, 4,233,731 and 4,237,609.

The term "independently recoverable" is used herein to refer to a recoverable article (of plastics or metal) that is held by its own molecular structure in a first state, changes being inducible within the molecular structure to cause the article to recover from the first state towards a second state.

SUMMARY OF THE INVENTION

It is the purpose of the instant invention to provide a wire-stripping arrangement which is independently capable of stripping an insulated wire. To accomplish this purpose the instant invention provides several devices which utilize recoverable material preferably in the form of heat-recoverable metal arranged to cause the penetration of the wire insulation and as desired the subsequent stripping of the insulation upon recovery of the material.

DETAILED DESCRIPTION

Figure 1:
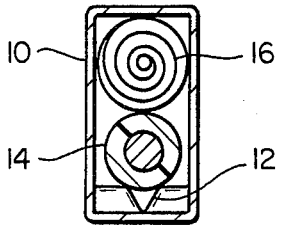
FIG. 1 is a cross-sectional view of a wire-stripping arrangement to grip and crush wire insulation.

In their most common form, heat-recoverable articles comprise a heat-shrinkable sleeve made from a polymeric material exhibiting the property of elastic or plastic memory as described, for example, in U.S. Pat. Nos. 2,027,962; 3,086,242 and 3,957,372. As is made clear in, for example, U.S. Pat. No. 2,027,962, the original dimensionally heat-stable form may be a transient form in a continuous process in which, for example, an extruded tube is expanded, whilst hot, to a dimensionally heat-unstable form but, in other applications, a preformed dimensionally heat stable article is deformed to a dimensionally heat unstable form in a separate stage.

In the production of heat recoverable articles, the polymeric material may be cross-linked at any stage in the production of the article that will enhance the desired dimensionally recoverability. One manner of producing a heat-recoverable article comprises shaping the polymeric material into the desired heat-stable form, subsequently cross-linking the polymeric material, heating the article to a temperature above the crystalline melting point or, for amorphous materials the softening point, as the case may be, of the polymer, deforming the article and cooling the article whilst in the deformed state so that the deformed state of the article is retained. In use, since the deformed state of the article is heat-unstable, application of heat will cause the article to assume its original heat-stable shape.

In other articles, as described, for example, in British Pat. No. 1,440,524, an elastomeric member such as an outer tubular member is held in a stretched state by a second member, such as an inner tubular member, which, upon heating weakens and thus allows the elastomeric member to recover.

Recoverable articles may also be formed from a "memory metal". "Memory metals" sometimes also called "Memory Alloys" are metallic materials which exhibit changes in strength and configurational characteristics on passing through a transition temperature, in most cases the transition temperature between the martensitic and austenitic states, and can be used to make heat-recoverable articles by deforming an article made from them whilst the metal is in its martensitic, low temperature, state. The article will retain its deformed configuration until it is warmed above the transition temperature to the austenitic state when it will return or attempt to return towards its original configuration. It will be understood that the heat-recoverable article is capable of returning towards its original configuration without the further application of outside force. The deformation used to place the material in the heat-unstable configuration is commonly referred to as thermally recoverable plastic deformation and can also, in certain cases, be imparted by introducing strains into the article above the transition temperature, whereupon the article assumes the deformed configuration on cooling through the transition temperature. It should be understood that the transition temperature may be a temperature range and that, as hysteresis usually occurs, the precise temperature at which transition occurs may depend on whether the temperature is rising or falling. Furthermore, the transition temperature is a function of other parameters, including the stress applied to the material, the temperatures rising with increasing stress.

Amongst such memory metals there may especially be mentioned various alloys of titanium and nickel which are described, for example in U.S. Pat. Nos. 3,174,851, 3,351,463, 3,753,700, 3,759,552, British Pat. Nos. 1,327,441 and 1,327,442 and NASA Publication SP 110, "55-Nitinol-The Alloy with a Memory, etc." (U.S. Government Printing Office, Washington, D.C. 1972). The property of heat-recoverability has not, however, been solely confined to such titanium-nickel alloys. Thus, for example, various beta-brass alloys have been demonstrated to exhibit this property in, e.g. N. Nakanishi et al, *Scripta Metallurgica* 5 433–440 (Pergamon Press 1971), U.S. Pat. Nos. 3,783,037, 4,019,925, 4,144,104, 4,146,392 and 4,166,739, and such materials may be doped to lower their transition temperature to cryogenic regimes by known techniques. Similarly, 304 stainless steels have been shown to enjoy such characteristics E. Enami et al, id, at pp. 663–68.

In general these memory metals have a transition temperature within the range of from −196° C. to +135°, especially from −196° C. to −70° C. (this being the lowest temperature they are liable to encounter during everyday use), and thus may be brought into their martensitic state by immersion into liquid nitrogen. However, more recently, it has been found possible to "precondition" memory metals so as transiently to raise their transition temperature. This enables the articles made from such alloys to be kept at room temperature prior to use, when they can be recovered by heating. Such preconditioning methods, which eliminate the need for liquid nitrogen during storage and transportation, are described, for example in U.S. Pat. Nos. 4,036,669, 4,067,752 and 4,095,999. A further method of treating such alloys in order to raise their effective transition temperature is described and claimed in U.S. Pat. No. 4,149,911.

As indicated above by application of a preconditioning process to a memory metal its transition temperature can be elevated. However, once recovery has been brought about by heating the article through its new transmission temperature, the memory metal's response to temperature change reverts to that it possessed prior to preconditioning. Accordingly, it remains austenitic until cooled to the temperature at which transition to martensite normally occurs, typically below the temperature environment likely to be encountered.

It has previously been proposed to provide electrical connectors with insulation penetrating means, to avoid the task of stripping the insulation of wires to be connected. Such penetrating means usually require crimping or some other mechanical pressure to be applied to the connector. In many cases it is desirable to provide the connector with a heat recoverable plastics sleeve, for example where an environment seal is necessary, and this is easily damaged by the crimping operation. In addition, crimped connections can be loosened by vibration.

It has been proposed in British Pat. No. 1,270,367 to use a heat shrinkable plastic cap to press a wire insulation against sharp cutting edges, but this could only be used with soft insulation materials because the forces involved must be very low if the cap itself is not to be undesirably cut. In U.S. Pat. No. 3,622,941 the recovery forces of a heat-recoverable sleeve are amplified by an insert providing a mechanical advantage, but these devices are relatively complicated in construction.

It will be understood that "insulated conductor or wire" means a conductor or wire with an applied covering of electrically insulating material, and is not intended to include wires merely having an oxidised surface layer which may be more or less electrically insulating.

References to stripping the wire insulation include partial stripping and/or stripping of relatively small portions of the total wire insulation, either along or around the wire, and cutting and axial displacement of the insulation relative to the wire without actual removal of the insulation therefrom.

Arrangements that are recoverable by heat are preferred for the present invention, but it is envisaged that other means of recovery, for example light or other radiant energy, or application of a fluid, may also be employed.

In accordance with one aspect of the present invention, there is provided a wire-stripping arrangement comprising recoverable wire-stripping means arranged to be capable upon recovery of stripping the insulation from an insulated wire held in the arrangement in use.

In accordance with another aspect of the invention, there is provided an arrangement for penetrating the insulation of an insulated wire, comprising an independently recoverable (as hereinbefore defined) penetration member arranged to be capable, upon recovery in use, of penetrating the insulation of an insulated wire positioned in the arrangement in use, and fusible electrically conductive material arranged upon fusion to make an electrical connection to the bared wire underlying the penetrated portion of the insulation.

The wire-stripping means or the independently recoverable penetration member may comprise a heat recoverable material, preferably heat-recoverable metal.

Arrangements that are recoverable by heat are advantageous in that the heat applied to effect the recovery also softens the insulation of the wire, thus assisting penetration thereof.

In many instances, it is advantageous to provide the arrangement with sleeving of recoverable plastics material, for example to provide environmental protection.

Arrangements of the invention are particularly useful in electrical connectors, and although the invention is not in general restricted thereto, reference hereinafter will be made to such applications.

By separating the functions of covering the point of contact, in arrangements using a heat recoverable plastics sleeve, and penetrating the insulation, using a penetration member which is itself capable of heat recovery (independently of any sleeve which may be present), the invention permits the use of relatively simple penetration members capable, at least in the case of heat recoverable metals, of exerting large forces on recovery, thereby permitting the penetration of very hard and tough wire insulation materials.

Heat-recoverable metals have a precise degree of recovery so that the insulation penetrating member can be designed to penetrate the insulation without damaging the wire. The use of an independently heat recoverable wire insulation penetration member also provides the further possibility that the penetrating member can exert a stripping action on the wire in an axial direction. Such a result is highly desirable in that a bared section of the wire is thereby made available for soldering or other means of connection. Accordingly, in a further aspect the invention provides an electrical connector comprising recoverable (as hereinbefore defined) penetration means arranged so that upon recovery thereof at least one portion thereof moves along an insulated wire held in the connector in use to penetrate and to strip the wire insulation. The recoverable penetration (and stripping) means in this embodiment of the invention need not be independently recoverable, and may be actuated by the recovery of a recoverable member separate from the actual penetration member, for example an independently heat recoverable metal member, or a recoverable member comprising a resilient member "held-out" by a fusible member positioned so as to maintain the insulation penetrating member in a heat unstable configuration from which it can recover on heating to penetrate and to strip the wire insulation.

A preferred material for the construction of the insulation penetration member is a heat recoverable beta-brass alloy since such an alloy can readily be made with recovery temperatures above ambient temperature and may be soldered or brazed by conventional techniques. Suitable beta-brass alloys are described in U.S. Pat. Nos. 4,146,392 and 4,166,739. Heat-recoverable beta-brass alloys have a further advantage in that they have some resiliency in the recoverable condition and may be arranged to be "held-out" by a suitably positioned fusible insert, thereby enhancing the degree of heat recoverability obtainable. Alternatively, such a member can be arranged to grip the wire resiliently and maintain it in place, prior to recovery.

A preferred embodiment incorporating the invention provides a device comprising fusible electrically conductive material arranged to make a permanent electrical connection to the wire underlying the penetrated or stripped portion of the insulation upon recovery of the penetration member and fusion of the electrically conductive material. In this case, a degree of relaxation after recovery can be tolerated in penetration member when made of the memory metal. Metals which recover irreversibly, preferably with little or no relaxation, are preferred, especially if the aforementioned fusible material, which may be solder, is not used.

A particularly preferred embodiment of an electrical device incorporating the invention comprises a heat recoverable plastics sleeve, an insert of a heat recoverable beta-brass alloy, the insert being provided with wire insulation penetrating and stripping means, and a quantity of solder, the device being such that when an insulated wire is inserted thereinto and heat applied thereto, the insert recovers, penetrating and stripping the insulation from a section of the wire, the solder melts and flows on to said section of the wire and the sleeve recovers tightly around the soldered section of the wire. Even if the insert merely penetrates, but does not strip, the insulation, a certain amount of stripping may in practice be effected due to shrinkage of the insulation away from the point of penetration upon heating.

Arrangements in accordance with the invention may be incorporated in electrical connectors used, for example, to connect pairs of wires, one or both of which may be covered with insulation material, or to connect a single insulated wire to a pin, connector tab or wire-wrap post. The electrical connector may form part of a larger connecting device such as a plug and socket connector or a coaxial cable termination or splice.

The heat recoverable plastics sleeve preferably used with arrangements in accordance with the invention may comprise any suitable plastics material, advantageously having good electrical insulation properties, which may be converted to or maintained in a heat recoverable, and preferably heat-shrinkable, form. Example of suitable materials are given in U.S. Pat. Nos. 3,086,242 and 3,297,819. Cross-linked polymeric materials, for example cross-linked polyvinylidene flouride, are particularly suitable. The sleeve is advantageously sufficiently transparent to enable the connection made therein to be inspected. The sleeve may be extruded as such, or may be formed from a sheet of material, opposite edges of the sheet being joined in any suitable manner. The sleeve may be open at one or both ends and may if desired be provided with a quantity of fusible material (for example fusible polymeric material) or other sealing material, adjacent the or each open end. The fusible material may act as a "dam" for any solder present, preventing it from flowing out of an open end of the sleeve during heating, and/or it may enhance the environmental seal at an end of the sleeve.

The insulation penetrating member is preferably capable of recovering independently, regardless of the presence of the sleeve, although its recovery in some embodiments may be assisted by the recovery of the sleeve. The penetrating member is preferably electrically conductive, and may, for example, consist of opposed clamping members or jaws which move together on recovery, thereby piercing the insulation by crushing or cutting. Where the penetration member is itself electrically conductive, the electrical connection may be made through it, although if it also performs a stripping function, the bared section of wire may be electrically connected by, for example, soldering, in which case the penetration member may consist of hard insulating material. Where it performs a stripping function, a portion of the penetration means may recover so as to grip the wire and to limit movement thereof whilst another portion may move axially or laterally of the wire to strip the insulation. Alternatively, two portions of the wire insulation penetration means may grip the wire and effect the stripping by moving axially or laterally of the wire in opposed directions. Insulation penetration and stripping may be performed by the same or different portions of the penetration means, which will usually have a recovery temperature similar to that of the sleeve, when present, preferably in the range of from 90° C. to 350° C.

A number of embodiments of the present invention, incorporated into electrical devices, will now be described, by way of example using memory metals, with reference to the partially-sectioned elevations shown in FIGS. 1 to 9 of the accompanying drawings.

Figure 2:
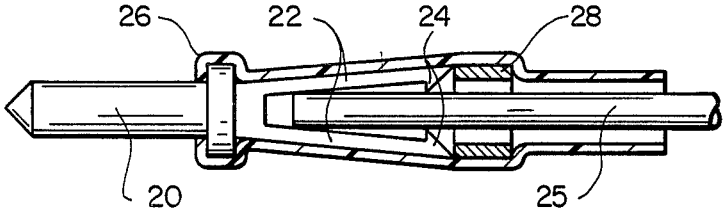
FIG. 2 is a cross-sectional view of a socket wire-stripping embodiment which penetrated the end of an insulated wire.

Referring now to the drawing:

FIGS. 1 and 2 illustrate devices wherein a memory metal member is arranged to grip and cut or crush the wire insulation, either by pressing the wire laterally into a V-shaped or other shaped notch (FIG. 1) or by a jaw action (FIG. 2).

FIG. 1 shows a metallic tube 10 having a V-shaped notch 12 into which the wire 14 is forced upon recovery of the memory metal spring 16 arranged within the tube 10. The slit or notch may have a rectangular or other cross-section if desired, and the memory metal may be in other configurations if convenient.

FIG. 2 illustrates a socket pin 20 provided with heat recoverable metal fingers 22 having sharp insulation penetrating teeth 24. The fingers are initially deformed as shown in FIG. 2 and a heat shrinkable sleeve 26 containing a solder ring 28 is applied over the fingers 22. In use an insulated wire 25 is inserted into the sleeve and into the cavity between the fingers 22 and the device is heated to the recovery temperature. On recovery, the teeth 24 penetrate the insulation and the solder ring 28 melts and flows so as to improve the electrical connection between the teeth and the exposed wire. If desired, the device can be arranged so that the teeth 24 also move along the wire to strip the insulation, e.g. as shown in FIG. 6, to allow the solder to have greater access to the wire.

Figure 5:
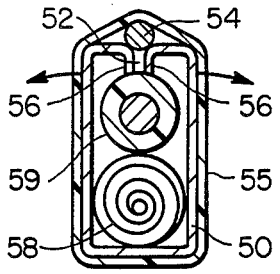
FIG. 5 is a cross-sectional view of yet another embodiment which utilizes two recoverable members to grip and strip.
Figure 6:
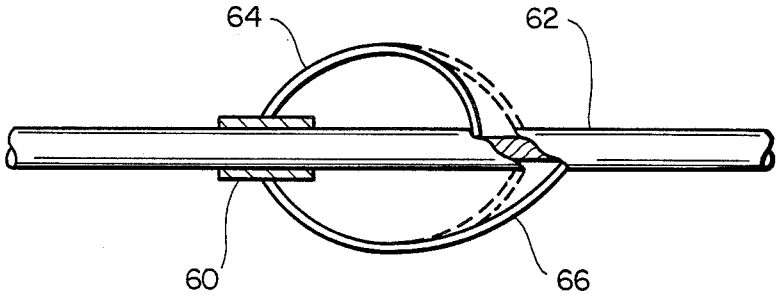
FIG. 6 is a partial cross-sectional view of another arrangement which recovers from the position shown in phantom line to penetrate the wire and to strip back the insulation.

FIGS. 3 to 6 illustrate "grip and strip" arrangements wherein a memory metal member is arranged to grip the wire and to strip the insulation either by movement of two gripping portions or the memory metal member (as in the flat strip of FIG. 3 or the dished discs of FIG. 4), or by movement of one or more portions of the memory metal member remote from the or each gripping portion (FIG. 6).

Figure 3:
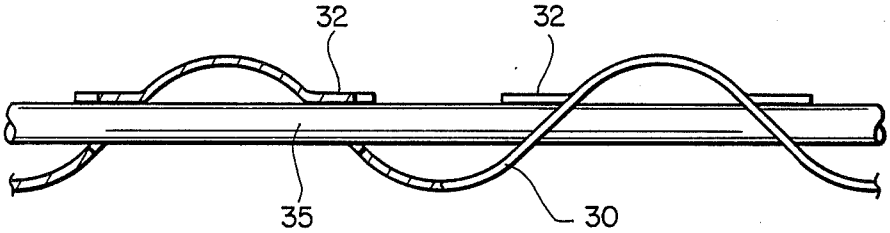
FIG. 3 is a partial cross-sectional view of an alternate wire-stripping embodiment which grips and strips an insulated wire.

FIG. 3 illustrates the principle of flat memory metal strips arranged to grip the wire and penetrate its insulation and then to move longitudinally along the wire so as to strip back the insulation. A section of the flat metal strip 30 has teeth or tangs 32 punched out of its so as to pierce the insulation. The strip is then deformed so as to allow a wire 35 to be passed through both of the resulting holes as shown in FIG. 3. The convolutions of the flat metal strip are repeated in close sinusoidal fashion to grip and strip the wire, and the direction of the teeth may alternate so that they contact alternately diametrically opposed sections of the wire. Upon recovery, the tangs grip the wire and penetrate the insulation and the strip recovers towards a flat configuration thereby moving the gripping tangs longitudinally along the wire.

In a modified form of this embodiment, the tangs 32 may be omitted, and each hole provided with at least one cutting edge. The strip is then arranged to straighten on recovery, and the holes to close transversely on to the inserted wire 35, to effect stripping of its insulation.

Figure 4:
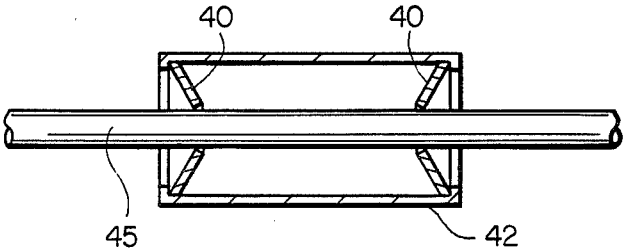
FIG. 4 is a cross-sectional view of another embodiment according to the instant invention which also grips and strips.

FIG. 4 illustrates the use of flat perforated discs which may be deformed towards a dished configuration, thus enlarging the central hole in the disc, so that upon recovery the hole will tend to grip the wire and a pair of discs 40 in a rigid shell 42 will tend to move the gripping apertures longitudinally along the wire 45 as the deformed discs return towards a flat configuration, thereby stripping the wire.

FIG. 5 shows an arrangement using two different kinds of memory metal, the first memory metal being performed into a member 50 of generally square corss-section having a longitudinal slot 52 adjacent to which is positioned an elongated body of solder 54, which may be rod-like or tubular in form. The walls of the slot 52 are bounded by insulation penetrating teeth 56. An insert of the second memory metal is shown at 58. In use, an insulated wire 59 is inserted into the cavity provided by the memory metal preform 50, and on heating, the insert 58 first expands pressing the unstripped wire against the insulation penetrating teeth 56, whereafter the first memory metal preform 50 recovers to draw the insulation penetrating teeth away from each other as indicated by the arrows in FIG. 5, thereby stripping the insulation from the wire 59. Finally, the solder 54 melts and flows to establish a permanent connection to the newly exposed stripped section of the wire, and a heat shrinkable plastics sleeve 55 is normally provided to seal the entire connection.

FIG. 6 shows an arrangement having a heat-recoverable gripping portion 60, of tubular form in this example, which recovers on heating to grip a wire 62 placed in the device in use, and radially spaced pairs of diametrically opposed memory metal jaws 64, 66 (only one typical jaw of each pair is shown) which recover to penetrate the wire at a point indicated by the phantom lines and then move in opposite directions to strip back the insulation from the point of penetration.

Figure 7:
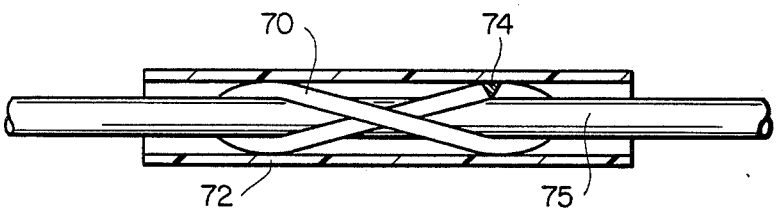
FIG. 7 is a cross-sectional view of yet another arrangement utilizing a twisted memory metal wire to cut and strip.

FIG. 7 illustrates an arrangement wherein a memory metal member is arranged to tighten a wire insulation cutter about the insulated wire. The cutting wire may be made of memory metal, or of non-memory metal wire in which case the memory metal will be arranged to pull tight the cutting wire to cut the insulation. Memory metal wire may advantageously have a sharp-cornered cross section and be deformed so as to twist axially on recovery, thus assisting the stripping action by scraping the sharp corners against the insulation.

More particularly, FIG. 7 shows a memory metal wire construction using a figure-of-eight shaped ring 70 of memory metal which on heating recovers about an insulated wire 75 inserted therein in use to penetrate and preferably strip the wire insulation. In this example, the memory metal loop 70 is shown within a heat shrinkable plastic tubing 72 which also recovers on heating of the connector to form a sealed enclosure around the stripped part of the wire. In devices such as these using memory metal wire, it may be advantageous for the wire to have a sharp-cornered cross-section e.g. triangular as indicated by cross-section 74, or to have sharp points or projections thereon to assist stripping, especially if the wire is arranged to twist axially on recovery. Although memory metal wire is mentioned here, it is possible to use non-memory metal wire, in which case a separate member of memory metal may be arranged to draw that wire tightly about the insulated wire to penetrate the insulation in the manner of a garrotte.

Figure 8:
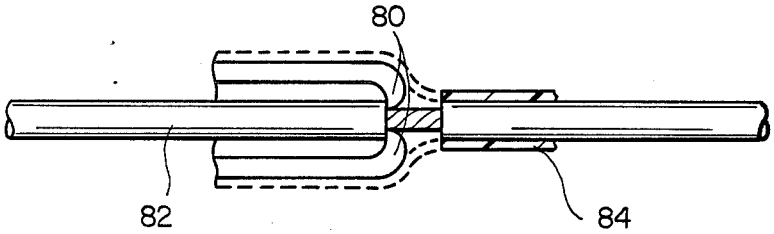
FIG. 8 is a cross-sectional view of still another arrangement utilizing memory metal and heat-recoverable polymeric tubing. An alternate feature of this embodiment is shown in phantom wherein the polymeric tube may extend over the memory metal members to accomplish penetration of insulation and wherein the metal members recover to strip longitudinally.

FIG. 8 illustrates a connector in which a recoverable plastics tubing co-operates with a memory metal member to effect penetration or stripping. The recoverable tubing, within which the wire is positioned in use, may recover along the wire to draw back the insulation from the point where it is penetrated by the memory metal member. Alternatively the tubing can recover radially to force the memory metal member to penetrate the wire insulation whereafter the memory metal member itself recovers to strip the insulation.

More particularly, FIG. 8 illustrates co-operation between a memory metal member and a heat recoverable polymeric tube, the memory metal penetration members 80 in FIG. 8 acting to pierce the insulation 82 at the point indicated, and the tube of heat recoverable polymer 84 recovering longitudinally to strip back the insulation from the point of penetration. An alternative embodiment of this metal/polymer co-operation is for the sleeve 84 to cover as shown in phantom the penetration members 80 made of memory metal, so as to be capable of driving them into the wire insulation, whereafter the penetration members themselves recover longitudinally to move along and strip the wire.

Figure 9:
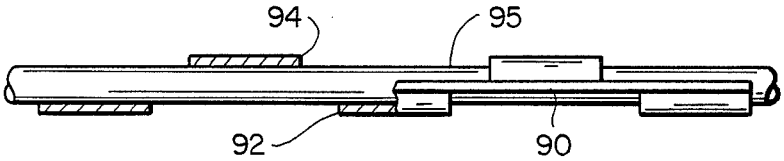
FIG. 9 is a partial cross-sectional view of another arrangement for insulation penetration like that accomplished by the devices of FIGS. 1 and 2 wherein the penetration was accomplished by a shearing movement. The insulation layer is not shown for purposes of clarity.

FIG. 9 illustrates the use of flat memory metal strips having displaced the insulation (not shown) on a conductor 95 by a shearing action. A section of flat metal strip 90 is slit or punched with rectangular-shaped openings having transverse cutting edges such as 92 and 94 arranged to penetrate the insulation. The strip is then deformed in alternating fashion to provide an axial opening for the wire 95. Upon recovery, the edges 92 and 94 move radially toward each other to shear the insulation on the wire 95. In the unrecovered state the elements associated with cutting edges 92 and 94 are angled relative to the major axis of the device.

It will be appreciated that all of the connectors illustrated above may use heat recoverable plastic sleeves to enclose the connection, although the sleeves have been omitted from many of the drawings for clarity.

From the foregoing description it is evident that there are a number of changes, adaptations and modifications of the present invention which come within the province of those skilled in the art. However, it is intended that all such variations not departing from the spirit of the invention be considered as within the scope thereof as limited solely by the appended claims.

What is claimed is:

1. An arrangement for penetrating the insulation of an insulated wire, comprising an independently recoverable penetration member at least partly made of memory metal, said member having an original undeformed shape and a deformed shape wherein thermally recoverable plastic deformation is imparted to the member and wherein the original undeformed shape is thermally recoverable alone from the deformed shape, said member in the deformed shape arranged to be capable, upon recovery in use, of penetrating the insulation of an insulated wire positioned in the arrangement in use.

2. An arrangement according to claim 1 wherein the memory metal member is resiliently deformable while in its recoverable state and is arranged to grip the insulated wire resiliently prior to recovery.

3. An arrangement according to claim 1, wherein the memory metal member is arranged to press the wire laterally of itself into a notch thereby to effect penetration of the wire insulation.

4. An arrangement according to claim 1, wherein the memory metal member is arranged to pull tight a loop of non-memory metal wire about the insulated wire.

5. An arrangement according to claim 1 wherein the independently recoverable component is heat recoverable.

6. An arrangement according to claim 1, wherein the memory metal member is arranged to provide jaws which recover on to the wire thereby to penetrate the insulation thereof.

7. An arrangement according to claim 6, comprising recoverable tubing within which the wire is positioned in use, the tubing being arranged to recover along the wire to strip the insulation from the region where it is penetrated by the memory metal member.

8. An arrangement according to claim 6 comprising recoverable tubing within which the wire is positioned in use, the tubing arranged to recover radially of the wire to urge the memory metal member to penetrate the wire insulation, the memory metal member being arranged to recover to strip the insulation.

9. An arrangement according to claim 1, wherein the memory metal member is in the form of a wire and is arranged on recovery to tighten about the insulated wire.

10. An arrangement according to claim 9, wherein the memory metal wire has a sharp-cornered cross-section and is arranged upon recovery to twist to assist cutting and stripping of the insulation.

11. An arrangement according to claim 1, wherein the memory metal member is arranged to provide a gripping portion which in use recovers to grip the wire at a first location therealong and to provide at least one penetrating portion which in use recovers to penetrate the insulation at another location along the wire and thereafter to move along the wire so as to strip the insulation.

12. An arrangement according to claim 11, wherein the memory metal member is formed as a bent strip, at least part of which is arranged to recover to grip the wire and to straighten to penetrate, and preferably to strip, the insulation.

13. An arrangement according to claim 1, comprising two members of memory metal, the members having different recovery temperatures.

14. An arrangement according to claim 13, wherein the two memory metal members are so arranged that in use the first member that recovers causes the wire to be gripped and the second member effects stripping of the insulation.

15. An electrical connector comprising a heat recoverable plastics sleeve, an insert of a heat recoverable beta-brass memory alloy, the insert being provided with insulation penetrating and stripping means, and a quantity of solder, the connector being such that when an insulated wire is inserted thereinto and heat applied thereto, the insert thermally recovers, penetrating and stripping the insulation from a section of the wire, the solder melts and flows on to said section of wire, and the sleeve recovers tightly around the soldered section of the wire.

* * * * *